US011905049B2

(12) United States Patent
Yoshida et al.

(10) Patent No.: US 11,905,049 B2
(45) Date of Patent: Feb. 20, 2024

(54) BINDING MACHINE

(71) Applicant: MAX CO., LTD., Tokyo (JP)

(72) Inventors: Yusuke Yoshida, Tokyo (JP); Kouichirou Morimura, Tokyo (JP); Ichiro Kusakari, Tokyo (JP)

(73) Assignee: MAX CO., LTD., Tokyo (JP)

( * ) Notice: Subject to any disclaimer, the term of this patent is extended or adjusted under 35 U.S.C. 154(b) by 56 days.

(21) Appl. No.: 17/172,574

(22) Filed: Feb. 10, 2021

(65) Prior Publication Data

US 2021/0245905 A1 Aug. 12, 2021

(30) Foreign Application Priority Data

Feb. 10, 2020 (JP) ..... 2020-021027

(51) Int. Cl.
*B65G 13/02* (2006.01)
*B65B 13/02* (2006.01)

(52) U.S. Cl.
CPC ..... *B65B 13/025* (2013.01)

(58) Field of Classification Search
CPC ..... B65B 13/28; B65B 13/285; B65B 13/04; E04G 21/122; E04G 21/123
See application file for complete search history.

(56) References Cited

U.S. PATENT DOCUMENTS 5,279,336 A 1/1994 Kusakari et al.
5,944,064 A * 8/1999 Saito ..... E04G 21/122 140/57
2004/0193185 A1 9/2004 McBrayer
2004/0244866 A1 12/2004 Ishikawa et al.
2006/0283516 A1 12/2006 Nagaoka et al.
2009/0283168 A1 11/2009 Kusakari
2009/0283169 A1 11/2009 Itagaki et al.
2010/0313991 A1 12/2010 Nagaoka et al.
2018/0187434 A1 7/2018 Itagaki et al.
(Continued)

FOREIGN PATENT DOCUMENTS

CN 108327970 A 7/2018
DE 19806690 A1 9/1999
(Continued)

OTHER PUBLICATIONS

Extended European Search Report for EP Application No. 21156049.5 dated Jul. 8, 2021. (8 pp).
(Continued)

*Primary Examiner* — Debra M Sullivan
(74) *Attorney, Agent, or Firm* — WEIHROUCH IP

(57) ABSTRACT

A binding machine is configured to feed a wire in a first direction, to curl the wire, to surround a to-be-bound object with the wire, to return the wire in a second direction opposite to the first direction, to wind the wire on the to-be-bound object, and to twist the wire, thereby binding the to-be-bound object. The binding machine includes: a main body; a reel accommodation unit; a wire feeding unit; a curl forming unit; a binding unit; a grip; a starter; and a feeding path. The reel accommodation unit is provided in the main body on an opposite side to the curl forming unit with respect to the starter, and the feeding path is provided with a load reducing part configured to reduce a load of the wire or the reel accommodation unit.

17 Claims, 15 Drawing Sheets

(56) References Cited

U.S. PATENT DOCUMENTS

| | | | | |
|---|---|---|---|---|
| 2018/0207709 | A1* | 7/2018 | Kasahara | B21F 15/04 |
| 2019/0249447 | A1 | 8/2019 | Itagaki et al. | |
| 2021/0010282 | A1 | 1/2021 | Itagaki et al. | |

FOREIGN PATENT DOCUMENTS

| | | | | | |
|---|---|---|---|---|---|
| GB | 0904359 | | | 4/2009 | |
| GB | 2468536 | A | | 9/2010 | |
| JP | H05-330507 | A | | 12/1993 | |
| JP | 07284870 | A | * | 10/1995 | E04G 21/123 |
| JP | H07-284870 | A | | 10/1995 | |
| JP | H08-034405 | A | | 2/1996 | |
| JP | H10-230908 | A | | 9/1998 | |
| JP | 2003034305 | A | | 2/2003 | |
| JP | 2004-175377 | A | | 6/2004 | |
| TW | 2005-23443 | A | | 7/2005 | |
| TW | 2010-06997 | A | | 2/2010 | |
| WO | 2009-142217 | A1 | | 11/2009 | |
| WO | 2017-010122 | A1 | | 1/2017 | |
| WO | 2017014276 | A1 | | 1/2017 | |

OTHER PUBLICATIONS

Chinese Office Action corresponding to Chinese Patent Application 202110182462.X dated May 30, 2023 (11 pp.).

* cited by examiner

BINDING MACHINE

CROSS-REFERENCE TO RELATED APPLICATION(S)

This application is based upon and claims the benefit of priority from prior Japanese patent application No. 2020-021027, filed on Feb. 10, 2020, the entire contents of which are incorporated herein by reference.

TECHNICAL FIELD

The present disclosure relates to a binding machine.

BACKGROUND ART

For concrete buildings, to-be-bound objects such as reinforcing bars are generally used so as to reinforce strength of a tensile force. Before placement of concrete buildings, the to-be-bound objects are bound with wires so that the reinforcing bars do not deviate from predetermined positions. In this case, if the binding by the wire is loosened, positions of the to-be-bound objects deviate, so that appropriate strength by the to-be-bound objects is not obtained. For this reason, it is required to firmly bind the to-be-bound objects by the wires.

The following technology is suggested to address such problem. For example, PTL 1 discloses a reinforcing bar binding machine configured to feed a wire in a loop shape and to wind the wire around reinforcing bars, to pull back the wire with maintaining a tip end of the wire and to wind the wire on the reinforcing bars, and to twist the wire, thereby binding the reinforcing bars with the wire.

[PTL 1] JP-A-2003-34305

However, according to the reinforcing bar binding machine disclosed in PTL 1, a wire reel is arranged on a front side of the main body. Therefore, when binding the to-be-bound objects for a complex building, the to-be-bound objects cannot be inserted into the reinforcing bar binding machine because a reel accommodation unit is provided on the front side of the main body, so that the to-be-bound objects cannot be bound. In some binding machines where the wire is not pulled back after the wire is wound on the to-be-bound object, the reel accommodation unit is arranged on a rear side of the main body. However, when feeding the wire, a wire feeding defect may occur or a feeding path in the binding machine is worn due to friction with the wire.

It is therefore an object of the present invention to provide a binding machine capable of preventing a wire feeding defect, wear of a feeding path in the binding machine, and the like even when a reel accommodation unit is arranged on a rear side of a main body.

SUMMARY OF INVENTION

According to an aspect of the present disclosure, there is provided a binding machine configured to feed a wire in a first direction, to curl the wire, to surround a to-be-bound object with the wire, to return the wire in a second direction opposite to the first direction, to wind the wire on the to-be-bound object, and to twist the wire, thereby binding the to-be-bound object, the binding machine comprising: a main body; a reel accommodation unit configured to rotatably accommodate a reel on which the wire is wound; a wire feeding unit provided in the main body and configured to feed the wire in the first direction and in the second direction; a curl forming unit provided on a tip end-side of the main body and configured to curl the wire fed by the wire feeding unit; a binding unit comprising a twisting shaft extending from the tip end-side to a rear end-side of the main body, and configured to twist the wire curled by the curl forming unit by rotation of the twisting shaft; a grip extending from a circumferential surface of the main body; a starter provided to the grip and configured to start the wire feeding unit; and a feeding path provided in the main body for feeding the wire in the first direction or in the second direction, wherein the reel accommodation unit is provided in the main body on an opposite side to the curl forming unit with respect to the starter, and wherein the feeding path is provided with a load reducing part configured to reduce a load of the wire or the reel accommodation unit.

According to an aspect of the present disclosure, since the reel accommodation unit is provided in the main body at the rear of the starter, it is possible to bind the to-be-bound object even though it is complex. In addition, since the feeding path is provided with the load reducing part, it is possible to reduce the load to the wire or the reel accommodation unit when feeding or returning the wire.

DESCRIPTION OF EMBODIMENTS

Hereinbelow, favorable embodiments of the present disclosure will be described in detail with reference to the accompanying drawings.

<Configuration Example of Reinforcing Bar Binding Machine 1A>

Figure 1:
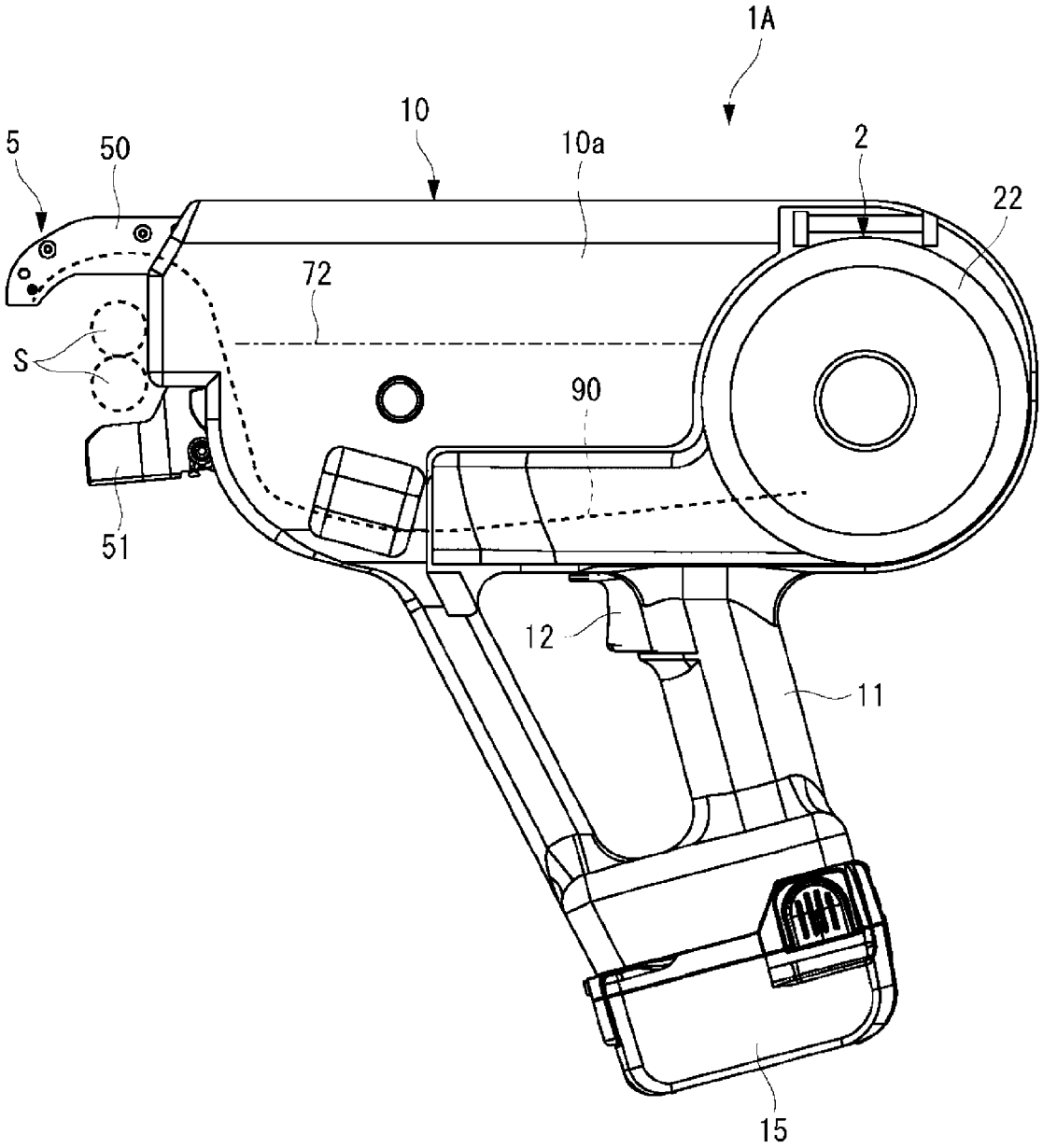
FIG. 1 is a side view of a reinforcing bar binding machine of the present embodiment.
Figure 2:
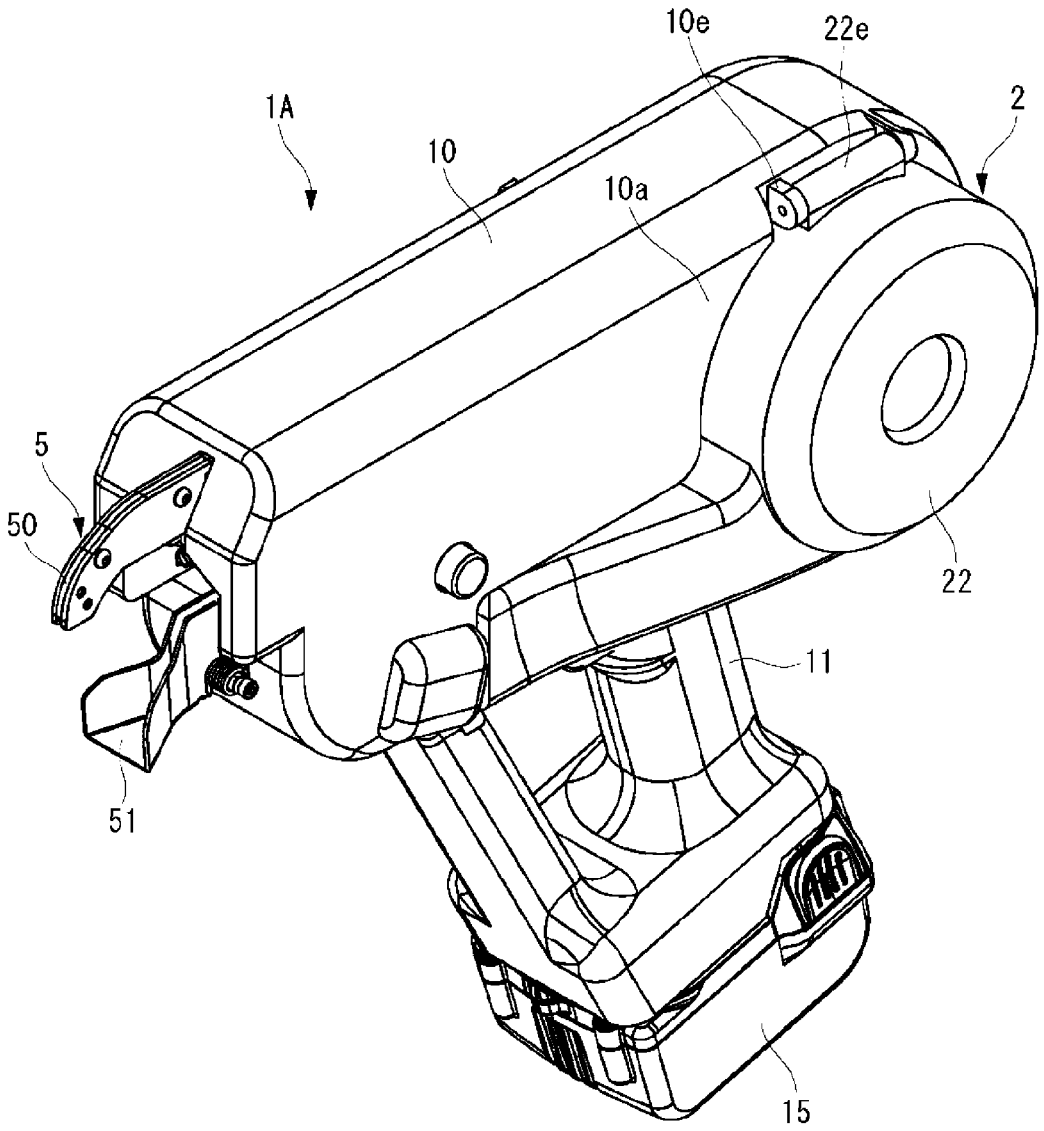
FIG. 2 is a perspective view of the reinforcing bar binding machine of the present embodiment.
Figure 3:
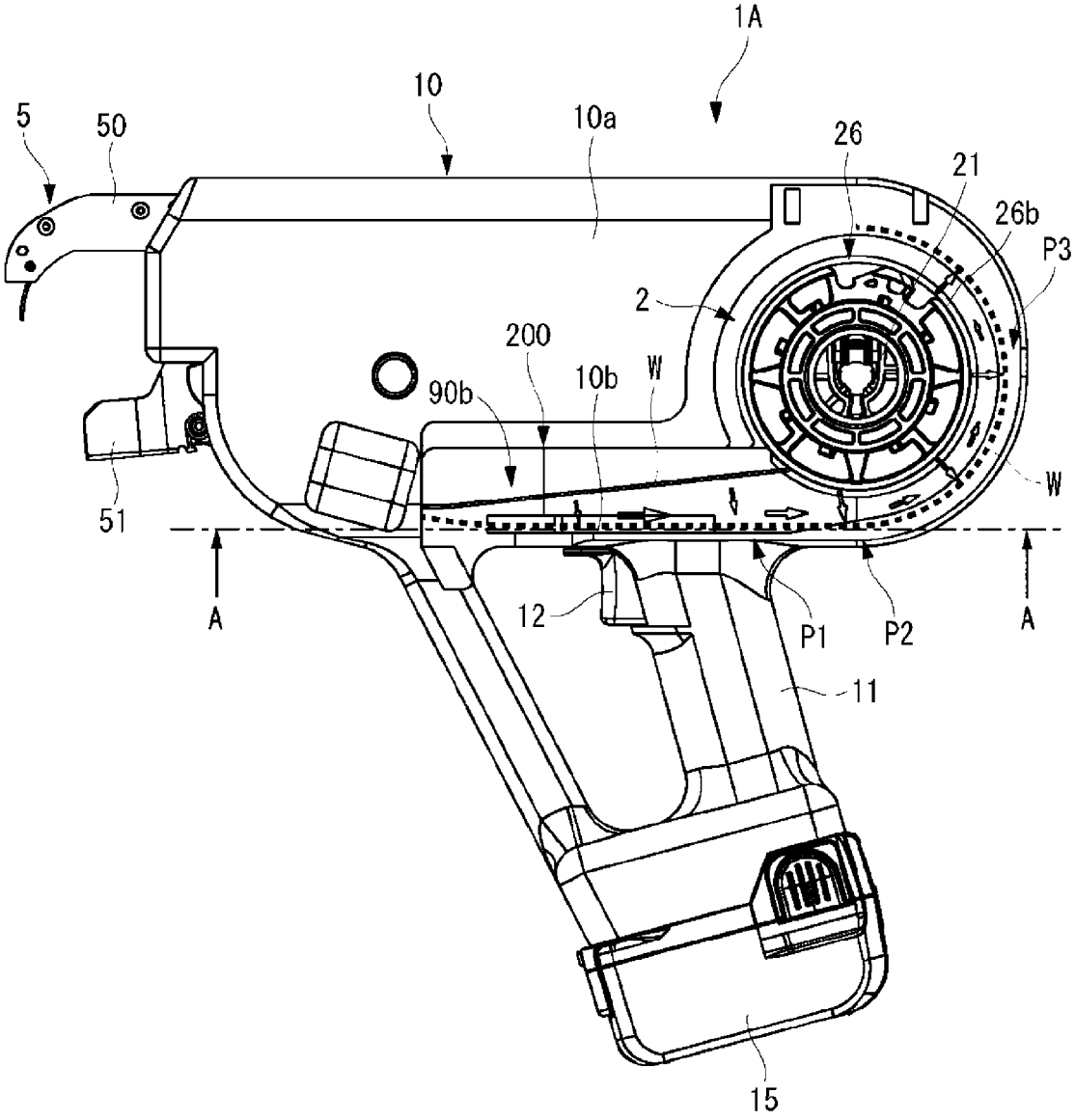
FIG. 3 is a side view depicting a state where a cover body of a reel accommodation unit of the reinforcing bar binding machine of the present embodiment is opened.
Figure 4:
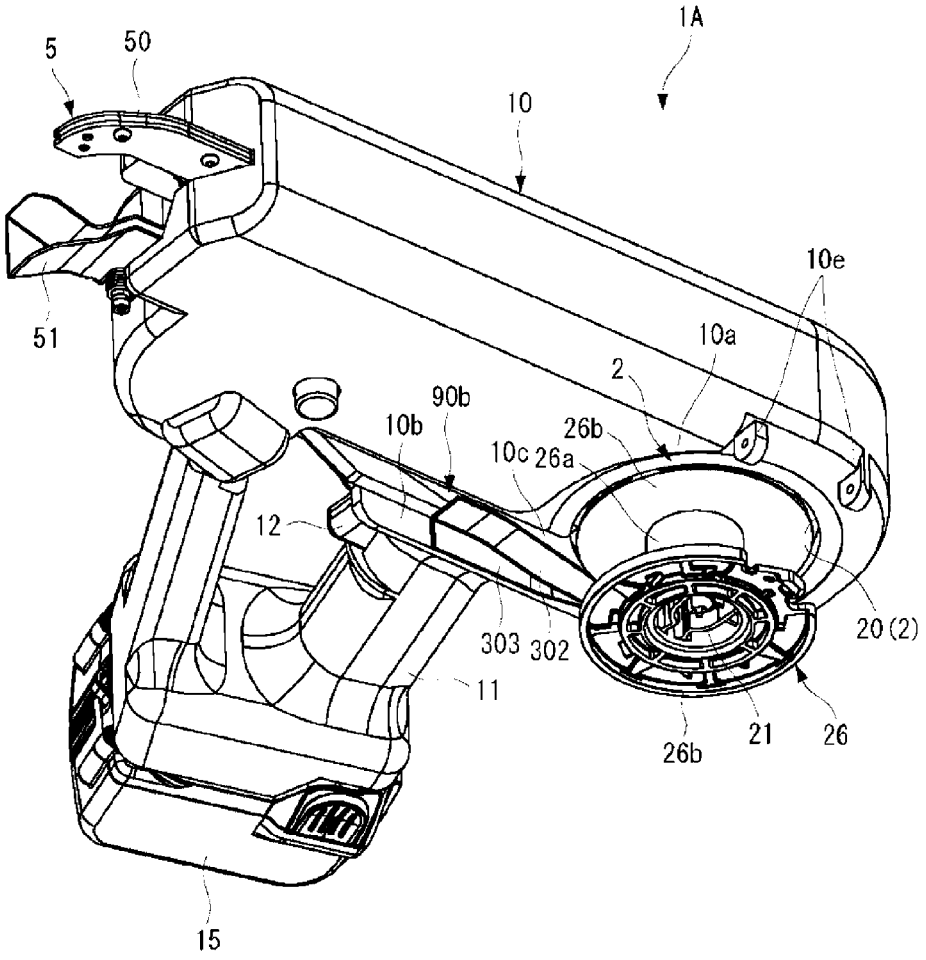
FIG. 4 is a perspective view depicting the state where the cover body of the reel accommodation unit of the reinforcing bar binding machine of the present embodiment is opened.
Figure 5A:
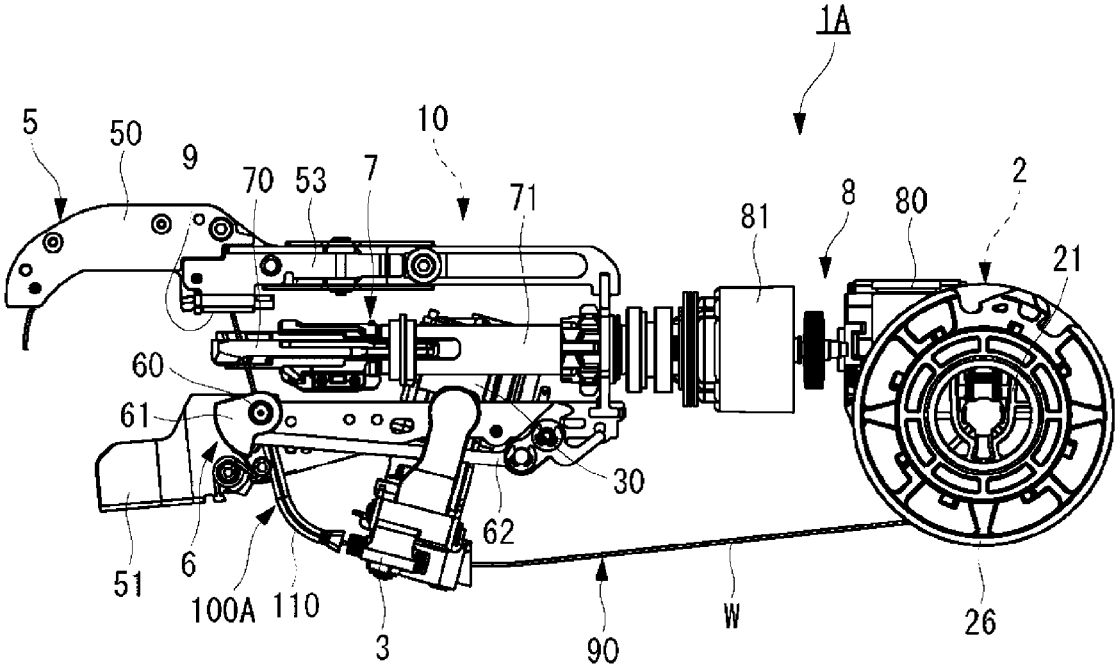
FIG. 5A is a side view depicting an internal configuration of the reinforcing bar binding machine of the present embodiment.
Figure 5B:
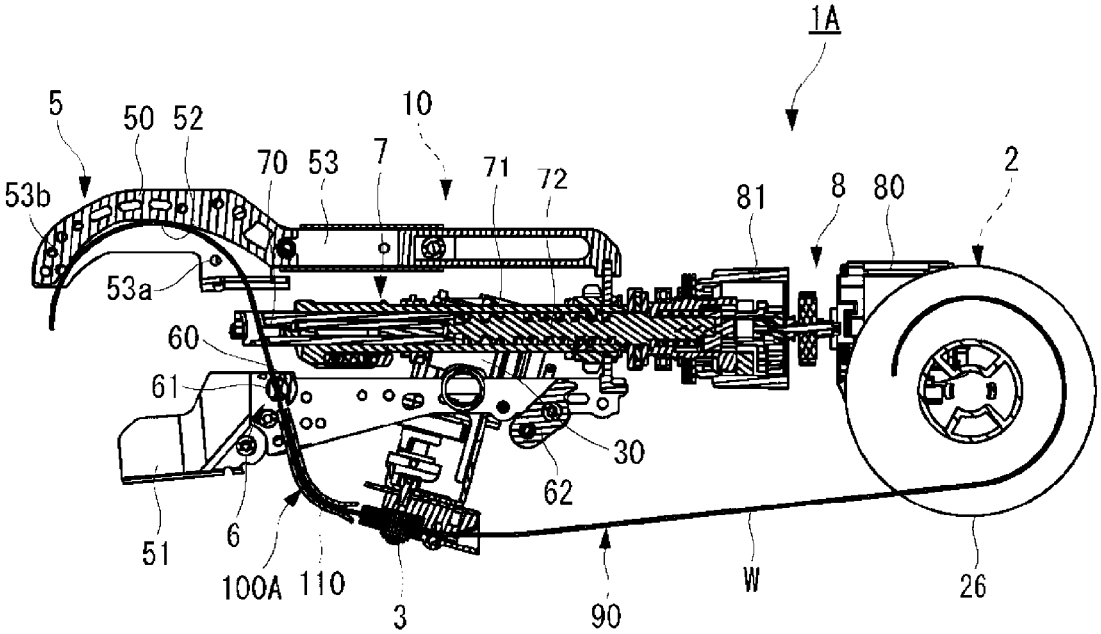
FIG. 5B is a sectional view depicting the internal configuration of the reinforcing bar binding machine of the present embodiment.
Figure 6A:
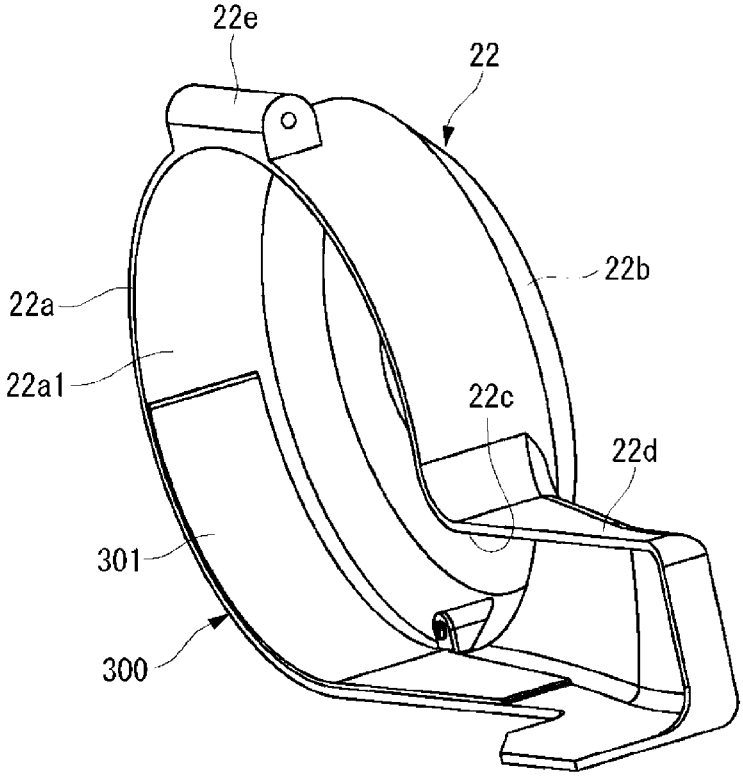
FIG. 6A depicts the cover body of the reel accommodation unit of the reinforcing bar binding machine of the present embodiment.
Figure 6B:
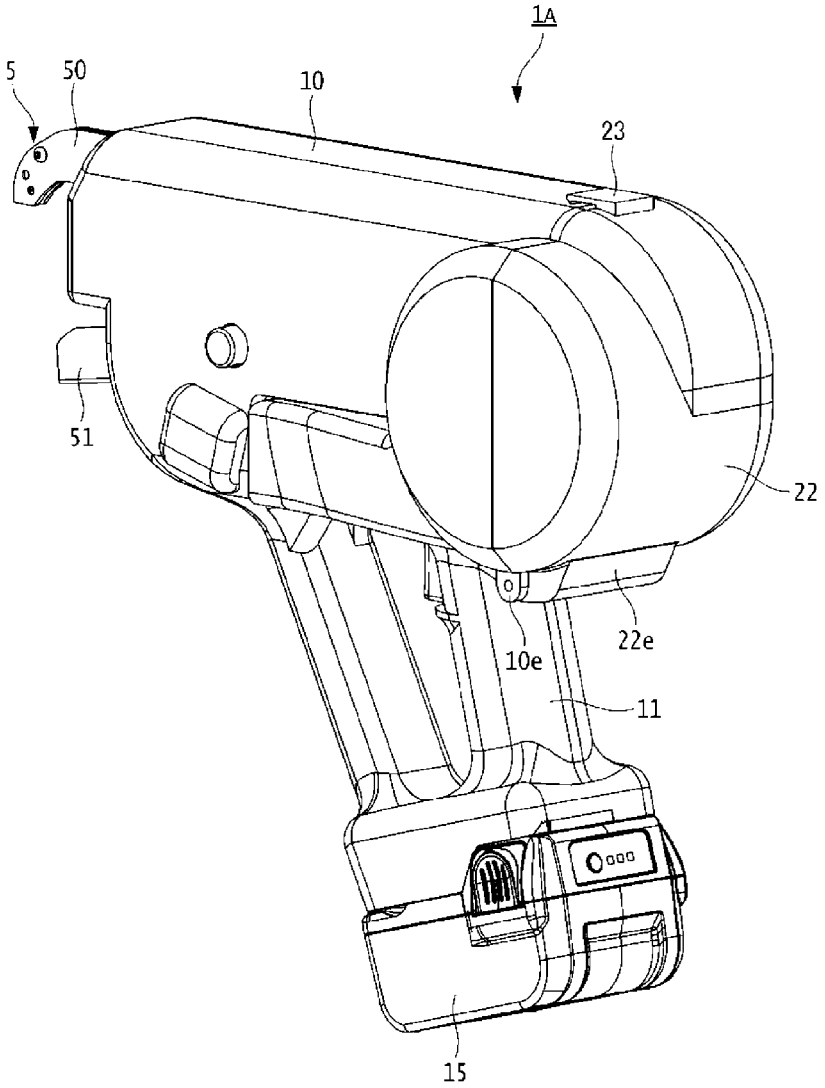
FIG. 6B depicts a modified embodiment of the reel accommodation unit.

FIG. 1 is a side view of a reinforcing bar binding machine 1A of the present embodiment, FIG. 2 is a perspective view of the reinforcing bar binding machine 1A, FIG. 3 is a side view depicting a state where a cover body 22 of a reel accommodation unit 2 of the reinforcing bar binding machine 1A is opened, FIG. 4 is a perspective view depicting the state where the cover body 22 of the reel accommodation unit 2 of the reinforcing bar binding machine 1A is opened, FIG. 5A is a side view depicting an internal configuration of the reinforcing bar binding machine 1A, FIG. 5B is a sectional view depicting the internal configuration of the reinforcing bar binding machine 1A, FIG. 6A depicts the cover body 22 of the reel accommodation unit 2, and FIG. 6B depicts a modified embodiment of the reel accommodation unit 2.

In the present embodiment, a longitudinal direction of the main body 10 (a direction corresponding to the right and left direction in FIG. 1) is referred to as the front and rear direction, a side on which a curl forming unit 5 is provided is referred to as a front side or a tip end-side of the reinforcing bar binding machine 1A, and a side on which a reel accommodation unit 2 is provided is referred to as a rear side of the reinforcing bar binding machine 1A. A side on which a battery 15 is provided and which is a direction orthogonal to the front and rear direction is referred to as a lower side of the reinforcing bar binding machine 1A, and an opposite side thereto is referred to as an upper side of the reinforcing bar binding machine 1A. A side (an inner side of the drawing sheet of FIG. 1) on which a twisting motor 80 is provided and which is orthogonal to the front and rear direction and the upper and lower direction of the reinforcing bar binding machine 1A is referred to as a right side of the reinforcing bar binding machine 1A, and a side (a front side of the drawing sheet of FIG. 1) on which the reel accommodation unit 2 is provided is referred to as a left side of the reinforcing bar binding machine 1A.

In the present embodiment, a direction in which a feeding motor 30 is rotated forward to feed a wire W from a wire feeding unit 3-side toward a curl forming unit 5-side is referred to as a forward direction (first direction), and a direction in which the feeding motor 30 is reversely rotated to feed the wire W from the curl forming unit 5-side toward the wire feeding unit 3-side is referred to as a reverse direction (second direction).

As shown in FIGS. 1 to 5B and the like, the reinforcing bar binding machine 1A includes a main body 10 having an elongated cuboid shape, a reel accommodation unit 2 in which a wire W is accommodated, a wire feeding unit 3 configured to feed the wire W in the forward direction and in the reverse direction, and a curl forming unit 5 configured to wind the wire W fed by the wire feeding unit 3 around reinforcing bars S. The reinforcing bar binding machine 1A also includes a cutting unit 6 configured to cut the wire wound on the reinforcing bars S by the wire feeding unit 3, a binding unit 7 configured to twist the wire W wound on the reinforcing bars S, and a drive unit 8 configured to drive the binding unit 7. According to the reinforcing bar binding machine 1A, the wire W is fed in the forward direction and wound around the reinforcing bars S, which are a to-be-bound object, the wire W wound around the reinforcing bars S is fed in the reverse direction and is then wound on the reinforcing bars S, and the wire W is then twisted, so that the reinforcing bars S can be bound with the wire W.

As shown in FIG. 1 and the like, the main body 10 is provided therein with a feeding path 90 for feeding the wire W in the forward direction or in the reverse direction. The feeding path 90 is formed with extending between the reel accommodation unit 2 and the curl forming unit 5 in the main body 10, below a twisting shaft 72 extending between the tip end-side and the rear end-side of the main body 10, more specifically, on a lower side in the main body 10.

As shown in FIGS. 1 to 6A, in the reel accommodation unit 2, a reel 26 on which the wire W is wound to be reeled out is rotatably accommodated and is also accommodated to be detachable and replaceable with respect to the main body 10. The reel accommodation unit 2 is arranged at a rear part of the main body 10 at the rear of a trigger 12. The reel accommodation unit 2 is arranged at a position offset in a left direction orthogonal to an axis direction of the twisting shaft 72, with respect to the wire feeding unit 3, The reel accommodation unit 2 has a concave part 20 formed on a left sidewall 10*a* of the main body 10, and a cover body 22 for opening/closing the concave part 20. The concave part 20 has a size capable of accommodating a flange part 26*b* (refer to FIG. 6A) on one side of the reel 26 having a substantially circular cylinder shape, and has a reel support part 21 configured to rotatably support the reel 26.

As shown in FIG. 6A, the cover body 22 has a peripheral wall 22*a* having a cylindrical shape, an end wall 22*b* for covering one opening of the peripheral wall 22*a*, an entry 22*c* for the wire W formed at a part of the peripheral wall 22*a*, and a path cover 22*d* configured to communicate with the entry 22*c* and to cover a part (a second path 90*b* to be described later) of the feeding path 90. An upper end portion of the peripheral wall 22*a* is provided with a rotation portion 22*e* for rotatably attaching the cover body 22 to the main body 10. The rotation portion 22*e* of the cover body 22 is attached to an attachment portion 10*e* (refer to FIG. 2) formed at the main body 10, so that the cover body 22 can rotate about the rotation portion 22*e* as a support point. When the cover body 22 is opened, the reel 26 can be set in the concave part 20 and the reel 26 set in the concave part 20 can be taken out. On the other hand, when the cover body 22 is closed, the cover body 22 is locked to the main body 10 by a lock mechanism (not shown).

In the present embodiment, a rotary shaft of the rotation portion 22*e* of the cover body 22 is arranged in the longitudinal direction of the main body 10, as shown in FIG. 2 and the like. However, as shown in FIG. 6B, the rotary shaft of the rotation portion 22*e* may be arranged in a width direction (right and left direction) of the main body 10 so that the reel 26 can be set from the rear of the main body 10, and the cover body 22 may be configured to be opened and closed with respect to the rear of the main body 10. In this case, for example, the attachment portion 10*e* is provided at a rear end portion of a lower surface-side of the main body 10, and the cover body 22 is configured to be rotatable about the rotary shaft (support point) of the rotation portion 22*e* of the cover body 22. In addition, an upper end portion of the cover body 22 may be provided with a lock mechanism 23 so that the cover body 22 can be locked to the main body 10. Furthermore, the rotation portion 22*e* and the attachment portion 10*e* may be provided on an upper side of the main body opposite to FIG. 6B. Also, the reel accommodation unit 2 may be arranged at a position further offset rearward than the twisting motor 80 in a state where the rotation portion 22*e* is provided in the longitudinal direction as shown in FIG. 1. In this case, the reel accommodation unit 2 may be arranged offset or without being offset with respect to the twisting motor 80.

As shown in FIG. 4, the reel 26 has a cylindrical hub part 26*a* on which the wire W is to be wound, and a pair of flange parts 26*b* and 26*b* provided integrally on both axial ends of the hub part 26*a*. One or more wires W are wound on the hub part 26*a* of the reel 26, and the wire W can be pulled out from the reel 26. For the wire W, a wire made of a plastically deformable metal wire, a wire having a metal wire covered with a resin, a twisted wire and the like are used.

As shown in FIG. 1 and the like, a grip 11 extends substantially downward from a lower surface that is a substantially intermediate part of the main body 10 in the longitudinal direction and a part of a circumferential surface of the main body 10. In other words, the grip 11 is provided below the twisting shaft 72 extending in the front and rear direction of the main body 10. An upper end portion of the grip 11 is provided on its front surface with a trigger 12 that is an example of the starter. When the trigger 12 is pulled by a user in a state where a power supply is on, a binding operation is executed. A battery 15 that configures a power supply unit is detachably attached to a lower part of the grip 11.

As shown in FIGS. 5A and 5B, the wire feeding unit 3 includes a pair of first and second feeding gears, and is configured to feed the wire W with sandwiching the wire W between grooves formed on gear teeth of the first feeding gear and grooves formed on gear teeth of the second feeding gear. The first feeding gear of the wire feeding unit 3 is connected, for example, to a feeding motor 30, so that it is rotated by drive of the feeding motor 30. The second feeding gear of the wire feeding unit 3 is driven to rotate in connection with rotation of the first feeding gear. In a case where a rotation direction of the feeding motor 30 is a forward rotation direction, the wire feeding unit 3 feeds the wire W in the forward direction, and in a case where the rotation direction of the feeding motor 30 is switched to a reverse rotation direction, the wire feeding unit 3 feeds the wire W in a reverse direction.

As shown in FIGS. 1 and 5B, the curl forming unit 5 is provided on the tip end-side of the main body 10 and above the twisting shaft 72. The curl forming unit 5 includes a curl guide 50 configured to curl the wire W that is fed by the wire feeding unit 3, and an induction guide 51 configured to guide the wire W curled by the curl guide 50 toward the binding unit 7.

As shown in FIG. 5B and the like, the curl guide 50 has a guide groove 52 configuring a feeding path of the wire W, and a first guide pin 53*a* and a second guide pin 53*b* configured to curl the wire W in cooperation with the guide groove 52. The first guide pin 53*a* is arranged on an upstream side of the curl guide 50 with respect to the forward direction, i.e., on an introduction side of the wire W and on an inner side with respect to the passing wire W. The second guide pin 53*b* is arranged on a downstream side of the curl guide 50 with respect to the forward direction, i.e., on a discharge side of the wire W and on an outer side with respect to the passing wire W.

The curl forming unit 5 includes a retreat mechanism 53 configured to retreat the first guide pin 53*a*. When feeding the wire W in the reverse direction by the wire feeding unit 3, the retreat mechanism 53 retreats the first guide pin 53*a* from the feeding path along which the wire W wound on the reinforcing bars S moves.

As shown in FIGS. 5A and 5B, the cutting unit 6 has a fixed blade part 60, a movable blade part 61 configured to cut the wire W in cooperation with the fixed blade part 60, and a transmission mechanism 62 configured to transmit an operation of the binding unit 7 to the movable blade part 61. The movable blade part 61 is configured to rotate about the fixed blade part 60 as a support axis by the operation of the binding unit 7 transmitted by the transmission mechanism 62, thereby cutting the wire W in cooperation with the fixed blade part 60.

As shown in FIGS. 5A and 5B, the binding unit 7 includes an engaging member 70 to which the wire W is to be engaged, an actuating member 71 configured to open/close the engaging member 70, and a twisting shaft 72 for actuating the engaging member 70 and the actuating member 71. The engaging member 70 is configured to operate in conjunction with movement of the actuating member 71, to hold a portion of the wire W in a movable state before passing through the curl forming unit 5, and to hold a portion of the wire W in a state where it does not come off from the engaging member 70 after passing through the curl forming unit 5. The actuating member 71 moves forward, thereby bending end portions of the wire W held on the tip end-side of the engaging member 70 toward the reinforcing bars S.

As shown in FIGS. 5A and 5B, the drive unit 8 includes a twisting motor 80, and a decelerator 81 for deceleration and torque amplification. The twisting shaft 72 and the twisting motor 80 are connected via the decelerator 81, so that the twisting shaft 72 is rotated by drive of the twisting motor 80 via the decelerator 81.

The reinforcing bar binding machine 1A of the present embodiment also includes a guide part 100A, a buckling prevention part 200 and a wear prevention part 300, which are included in a load reducing part.

Figure 7:
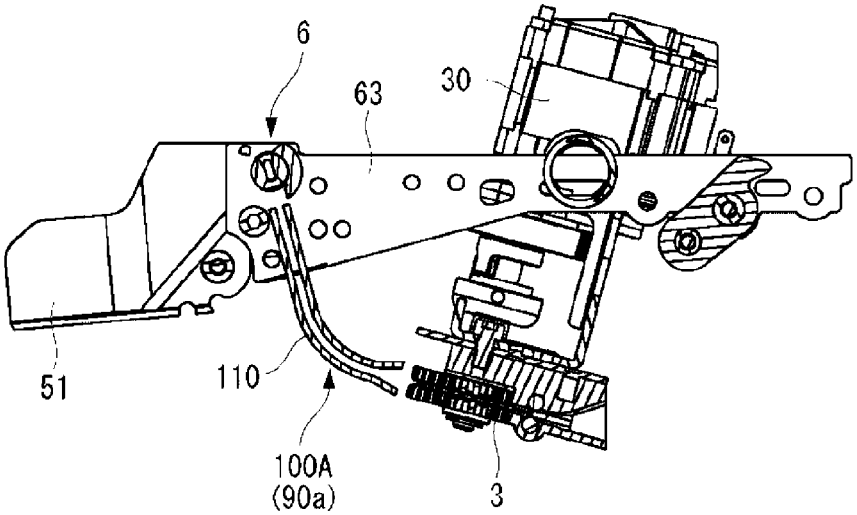
FIG. 7 is a sectional view depicting a guide part of the present embodiment.

First, the guide part 100A is described. FIG. 7 is a sectional view depicting the guide part 100A of the present embodiment. As shown in FIG. 7, the guide part 100A is provided between the wire feeding unit 3 (refer to FIG. 5A) and the cutting unit 6, and guides the wire W when feeding the wire W to the curl forming unit 5 and when pulling back the wire W fed to the curl forming unit 5. Here, before describing the guide part 100A, a problem that occurs in the feeding path 90 when the reel accommodation unit 2 is arranged at the rear part of the main body 10 is described.

When the reel accommodation unit 2 is arranged at a rear part of the main body 10, the wire W is fed to the curl forming unit 5 through the feeding path formed above or below the twisting shaft 72 in the main body 10. In a reinforcing bar binding machine where the reinforcing bars S are surrounded by the wire W and the wire W is then returned, since it is necessary to cross the wire W at the binding unit 7, the curl forming unit 5 is arranged on an opposite side to the feeding path of the wire W. In the reinforcing bar binding machine 1A of the present embodiment, as shown in FIG. 1, when the feeding path 90 of the wire W is provided on a lower side in the main body 10, the curl forming unit 5 is arranged above the twisting shaft 72.

For this reason, in order to feed the wire W from the feeding path 90 on the lower side in the main body 10 to the curl forming unit 5 on the upper side, a feeding path having a bending portion should be provided between the wire feeding unit 3 and the curl forming unit 5. In this case, a curvature of the feeding path of the wire W is reduced. Therefore, when feeding the wire W in the forward direction or in the reverse direction, the wire W is contacted to the bending portion in the feeding path and a load resistance against the wire W increases, so that a feeding defect of the wire W may be caused. Therefore, in the present embodiment, the guide part 100A for reducing the load resistance when feeding and returning the wire W is provided between the wire feeding unit 3 and the curl forming unit 5. Note that, in the present embodiment, a feeding path having a bending portion, which is provided between the wire feeding unit 3 and the curl forming unit 5, of the feeding path 90 is referred to as a first path 90*a*.

In the present embodiment, as shown in FIG. 7, the guide part 100A includes a pipe 100 having a diameter larger than a diameter of the wire W. The pipe 110 is curved from the wire feeding unit 3 toward the curl forming unit 5 (cutting unit 6), and functions as the first path 90*a* of the wire W between the wire feeding unit 3 and the curl forming unit 5. A downstream end portion of the pipe 110 is attached to a plate 63 configuring the cutting unit 6, for example. An upstream end portion of the pipe 110 extends ahead of the wire feeding unit 3 and has a wider diameter than other portion so that the wire W can be easily inserted therein, so that an opening area is large. The pipe 110 is formed of a low friction material capable of reducing the load resistance upon contact of the wire W that is fed by the wire feeding unit 3. Examples of the low friction material include self-lubricating composite materials such as dry bearings, and a surface treatment such as hard chromium plating and vanadium carbide coating can be used. More preferably, the pipe 110 has high wear resistance.

Figure 8A:
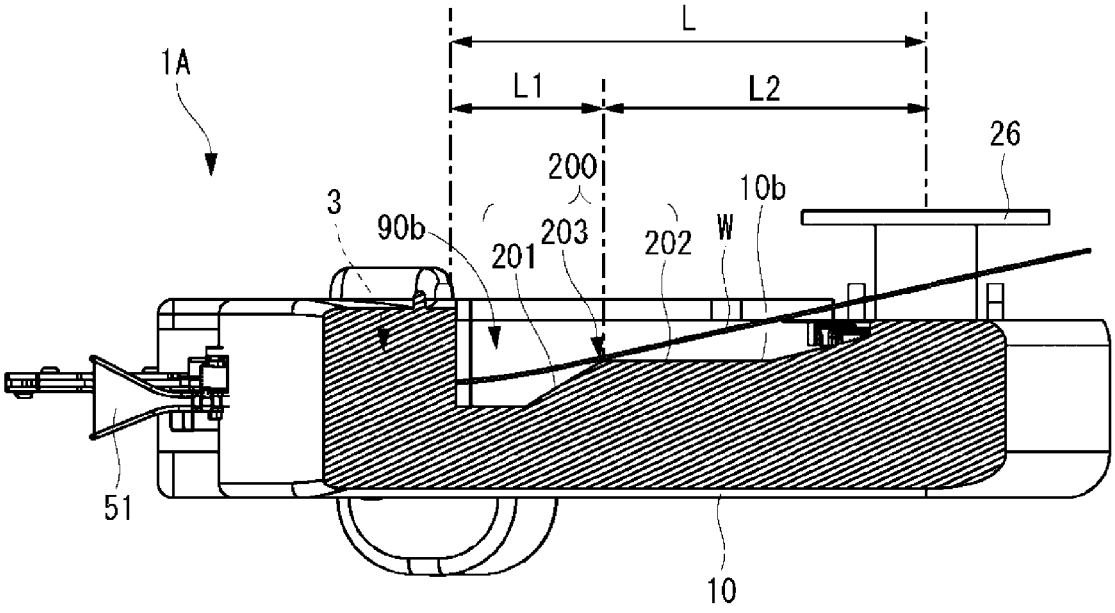
FIG. 8A is a sectional view taken along a line A-A of the reinforcing bar binding machine shown in FIG. 3, depicting a buckling prevention part.
Figure 8B:
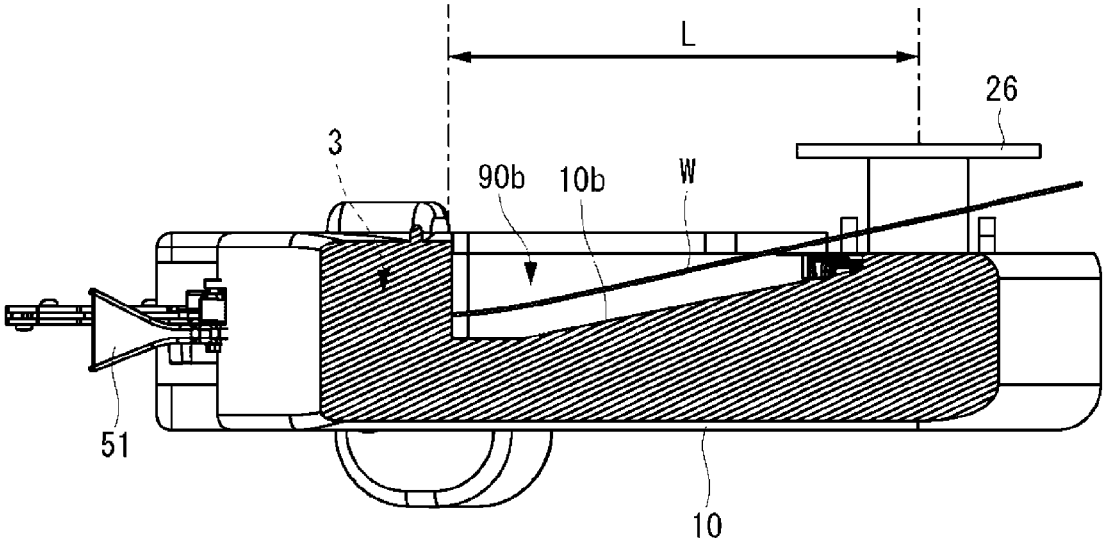
FIG. 8B is a sectional view taken along the line A-A of the reinforcing bar binding machine, depicting a case where the buckling prevention part shown in FIG. 3 is not provided.

Subsequently, the buckling prevention part 200 is described. FIG. 8A is a sectional view taken along a line A-A of the reinforcing bar binding machine 1A shown in FIG. 3, depicting the buckling prevention part 200 of the present embodiment. FIG. 8B depicts a state of the wire in a case where the buckling prevention part 200 is not provided. Note that, a feeding path, which is provided between the reel accommodation unit 2 and the wire feeding unit 3, of the feeding path 90 is referred to as a second path 90*b*.

As shown in FIG. 8A, the buckling prevention part 200 is provided on the second path 90*b* connecting the reel accommodation unit 2 and the wire feeding unit 3, and prevents buckling of the wire W by supporting a portion of the wire W when returning the wire W. Here, before describing the buckling prevention part 200, a problem of the buckling of the wire W that occurs on the second path 90*b* when the reel accommodation unit 2 is arranged at the rear part of the main body 10 is described.

When returning the wire W, the reel 26 is a little rotated or is barely rotated by a returning amount (urging force) during returning of the wire W because the reel is a driven member. For this reason, during the returning, the wire W spreads toward a bottom wall 10*b* of the second path 90*b* and is pushed and fed to the upstream side of the reel accommodation unit 2, as shown with the wire W of the broken line in FIG. 3. Thereby, when returning the wire W, a compression force is applied to the wire W spread toward the bottom wall 10*b* from the wire feeding unit 3-side toward the reel accommodation unit 2-side, so that the wire W is buckled. Note that, during the returning, since the wire W is fed stretched from the reel 26 by drive of the wire feeding unit 3, the wire W passes through a wire path shown with the solid line in FIG. 3.

Here, a buckling theory of the wire W is described. The buckling refers to a phenomenon that when a load applied to a structure (to-be-bound object) is gradually increased, a deformation manner suddenly changes at certain load, thereby causing large deflection or bending in the structure. The load at which the buckling phenomenon is caused in a structure is referred to as a buckling load of the structure. The buckling load is expressed by a following equation (1).

$$Pk=\pi^2(EI/L^2) \quad (1)$$

In the equation (1), Pk is a buckling load (also referred to as buckling-bearing strength), E is a Young's modulus, I is a cross-sectional secondary moment, and L is a buckling length (a distance between support points).

The buckling load Pk means that even when the buckling load Pk is applied, the buckling is not caused in the structure. For this reason, when the buckling length L is shorter, the buckling load Pk increases and the buckling of the wire W is more difficult to occur. Therefore, as shown in FIG. 8B, when a distance between support points between the wire feeding unit 3 and the reel 26 is set as the buckling length L, the buckling load Pk is reduced, so that the buckling is likely to occur when returning the wire W.

In contrast, according to the present embodiment, as shown in FIG. 8A, the buckling prevention part 200 configured to support a portion of the wire W when returning the wire W is provided on the bottom wall 10*b* of the second path 90*b* between the reel accommodation unit 2 and the wire feeding unit 3, for example. The buckling prevention part 200 includes, for example, at least a first surface 201 having a larger inclination than an inclination of the wire W during the returning, and a second surface 202 having a smaller inclination than the inclination of the wire W. An end side on an upstream side of the first surface 201 and an end side on a downstream side of the second surface 202 are connected to each other, and the connection part configures a support part 203 that is to contact the wire W.

The buckling prevention part 200 is provided on the way of the second path 90*b* between the wire feeding unit 3 and the reel 26, so that the buckling length L shown in FIG. 8B can be divided into a buckling length L1 between the wire feeding unit 3 and support part 203 and a buckling length L2 between the support part 203 and the reel 26, as shown in FIG. 8A. Therefore, the buckling length L shown in FIG. 8B can be set substantially short, and the buckling load Pk in the equation (1) in each section of the buckling lengths L1 and L2 can be increased. Thereby, it is possible to prevent the buckling on the second path 90*b* when returning the wire W.

Subsequently, the wear prevention part 300 is described. As shown in FIGS. 4 and 6A, and the like, the wear prevention part 300 is configured to reduce the friction between the wire W and the reel accommodation unit 2 during the returning of the wire W or to protect the reel accommodation unit 2 by a rigid material, thereby preventing the wear of the reel accommodation unit 2. Before describing the wear prevention part 300, a problem of the wear that occurs in the reel accommodation unit 2 when the reel accommodation unit 2 is arranged at the rear part of the main body 10 is described.

When returning the wire W, the reel 26 is barely rotated or is a little rotated by the returning amount (urging force) during the returning of the wire W because the reel is a driven member. For this reason, during the returning, the wire W is fed spreading in an outer periphery direction of the peripheral wall 22*a* of the cover body 22 of the reel accommodation unit 2, as shown with the wire W of the broken line in FIG. 3. Thereby, the wire W is contacted in the reel accommodation unit 2, so that a predetermined part of the reel accommodation unit 2 is rubbed and worn.

Here, a logical equation of the wear is expressed by a following equation (2).

$$W=K\cdot P\cdot V\cdot T \tag{2}$$

In the equation (2), W is an estimated wear size, K is a specific wear amount, P is a load surface pressure, V is a sliding velocity, and T is a friction time.

As can be clearly seen from the equation (2), the wear amount K correlates with the load surface pressure P and the sliding velocity V. Thereby, it can be seen that the wear of the machine including the reel accommodation unit 2 and the like is more likely to occur in a part where the load surface pressure P×the sliding velocity V (hereinbelow, referred to as PV value) is larger. Therefore, in the present embodiment, the wear prevention part 300 is provided at a position in the reel accommodation unit 2, which is likely to be worn. The position in the reel accommodation unit 2, which is likely to be worn, is described as follows, for example.

As shown in FIGS. 3 and 6A, in a position P1 in the vicinity of the entry 2*c* of the reel accommodation unit 2, a moving velocity of the wire W is high but a force in the returning direction is high and a pressure with which the wire W contacts the reel accommodation unit 2 and the load surface pressure P are relatively lower. However, the wire W is contacted to the reel accommodation unit 2, so that the reel accommodation unit 2 and the like are a little worn.

On a further upstream side in the reel accommodation unit 2 than the position P1, specifically, in a position P2 on a lower part-side in the reel accommodation unit 2, the wire W spreads in the outer periphery direction of the reel 26 and is contacted to an inner peripheral surface 22*a*1 of the reel accommodation unit 2, and the like. In the position P2, the moving velocity of the wire is also high when returning the wire W. For this reason, the PV value is greatest, and the wear amounts of the reel accommodation unit 2 and the like also increase.

In addition, on a further upstream side in the reel accommodation unit 2 than the position P2, specifically, in a position P3 substantially flush with the hub part 26*a* of the reel 26 in the reel accommodation unit 2, the returning velocity of the wire W gradually decreases. For this reason, the PV value decreases, so that the wear amounts of the reel accommodation unit 2 and the like are smaller than at the second position P2.

Therefore, in the present embodiment, the wear prevention part 300 consisting of a rigid plate, for example, is provided on the second path 90*b* and at a position including the first position P1, the second position P2 and the third position P3 in the reel accommodation unit 2. As shown in FIGS. 4 and 6A, the wear prevention part 300 has a first plate 301 provided on the inner peripheral surface 22*a*1 of the reel accommodation unit 2, a second plate 302 provided on a sidewall 10*c* configuring the second path 90*b*, and a third plate 303 provided extending between the bottom wall 10*b* configuring the second path 90*b* and an inside of the reel accommodation unit 2.

Note that, the wear prevention part 300 may be provided only at the second position P2 at which the wear amount is large or may be provided only at the second position P2 and the third position P3 at which the wear amount is the first and second largest. In addition, a thickness of the wear prevention part 300 may be adjusted to be stepwise reduced in descending order of the wear amount. In the present embodiment, the wear prevention part 300 is configured by the rigid plate. However, the present disclosure is not limited thereto. For example, a member capable of preventing wear due to the wire W can be adopted as appropriate. Also, the wear prevention part 300 is configured as a separate member from the reel accommodation unit 2. However, the reel accommodation unit 2 itself may be formed of a high hardness material.

<Example of Operation of Reinforcing Bar Binding Machine 1A>

Subsequently, an operation of binding the reinforcing bars S with one wire W by the reinforcing bar binding machine 1A is described with reference to the respective drawings. Note that, the reinforcing bar binding machine 1A is in a standby state where the wire W is sandwiched by the wire feeding unit 3 and the tip end of the sandwiched wire W is positioned between the wire feeding unit 3 and the cutting unit 6 or the tip end of the wire W is position in the cutting unit 6.

When the reinforcing bars S, which are a to-be-bound object, are inserted between the curl guide 50 and the induction guide 51 of the curl forming unit 5 and the trigger 12 is operated, the feeding motor 30 is driven in the forward rotation direction, so that the wire feeding unit 3 is rotated in the forward direction. Thereby, the wire W is fed in the forward direction. In the present embodiment, the guide part 100A is provided between the wire feeding unit 3 and the curl forming unit 5. Therefore, the friction between the wire W and the guide part 100A when feeding the wire W can be reduced, so that the load resistance of the wire W is reduced.

When the wire W is fed in the forward direction, the wire W passes through the tip end of the engaging member 70 and also passes through the curl guide 50 of the curl forming unit 5. Thereby, the wire W is curled by the first guide pin 53*a* and the second guide pin 53*b*, etc.

The wire W curled by the curl guide 50 is guided to the induction guide 51 and is further fed in the forward direction by the wire feeding unit 3, so that the wire passes through the tip end of the engaging member 70 and is butted against a feeding regulation part 9. The drive of the feeding motor 30 is stopped.

After stopping the feeding of the wire W in the forward direction, the twisting motor 80 is driven in the forward rotation direction. The rotation of the twisting motor 80 is converted into linear movement via the twisting shaft 72 and the like, so that the actuating member 71 is moved forward. When the actuating member 71 is moved forward, a portion of the wire W before passing through the curl forming unit 5 is held so as to be movable by the engaging member 70, and the wire W after passing through the curl forming unit 5 is held so as not to come off from the engaging member 70 by the engaging member 70.

In addition, when the actuating member 71 is moved forward, the operation of the actuating member 71 is transmitted to the retreat mechanism 53, so that the first guide pin 53*a* is retreated.

Continuously, the rotation of the twisting motor 80 is temporarily stopped, and the feeding motor 30 is driven in the reverse rotation direction. Thereby, the wire feeding unit 3 is reversely rotated, so that the wire W sandwiched by the wire feeding unit 3 is fed in the reverse direction. Since the tip end of the wire W is held by the engaging member 70, the wire W is wound so as to closely contact the reinforcing bars S.

In the present embodiment, since the second path 90*b* is provided with the buckling prevention part 200, a portion of the wire W that is fed in the reverse direction when returning the wire W is supported by the support part 203. Thereby, since the buckling load of the wire W can be increased, the buckling of the wire W on the second path 90*b* is prevented. In addition, since the reel accommodation unit 2 is provided with the wear prevention part 300, even when the wire W that is fed in the reverse direction spreads in the outer periphery direction of the reel 26, the wear of the reel accommodation unit 2 due to the contact of the wire W is prevented.

After stopping the feeding motor 30, the twisting motor 80 is driven in the forward rotation direction, so that the actuating member 71 is moved forward and the wire W held by the engaging member 70 is cut by the operations of the fixed blade part 60 and the movable blade part 61.

After the wire W is cut, the end portions of the wire W are each bent toward the reinforcing bars S. After the end portions of the wire W are bent, the twisting motor 80 is further driven in the forward rotation direction, so that the actuating member 71 rotates in conjunction with the twisting shaft 72 and the engaging member 70 holding the wire W rotates integrally with the actuating member 71, thereby twisting the wire W.

As described above, according to the present embodiment, the reel accommodation unit 2 is provided at the rear of the trigger 12, specifically, at the rear part of the main body 10. Therefore, for example, even when binding a to-be-bound object having a complex structure, the reel accommodation unit 2 is not an obstacle and the to-be-bound object can be smoothly inserted between the curl guide 50 and the induction guide 51. Thereby, the reinforcing bar binding machine 1A can be used for the to-be-bound objects of several structures.

In addition, according to the present embodiment, even when the reel accommodation unit 2 is provided at the rear part of the main body 10, since the first path 90*a* having the bending portion is configured by the guide part 100A, it is possible to reduce the load resistance of the wire W against the first path 90*a* when feeding and returning the wire W. Thereby, it is possible to prevent the wire W from slipping in the wire feeding unit 3, so that it is possible to prevent the feeding defect of the wire W.

In addition, according to the present embodiment, since the second path 90*b* is provided with the buckling prevention part 200, a portion of the wire W can be supported by the support part 203 during the returning of the wire W. Thereby, since it is possible to disperse and reduce the load that is applied to the wire W, it is possible to prevent the buckling in the reinforcing bar binding machine 1A during the returning of the wire W, so that it is possible to avoid the binding defect and the machine failure.

Additionally, according to the present embodiment, since the wear prevention part 300 is provided in the reel accommodation unit 2, it is possible to prevent the wear, which is caused as the wire W is contacted to the inner peripheral surface 22*a*1 of the reel accommodation unit 2 and the like, during the returning of the wire W. Thereby, it is possible to improve the durability of the reinforcing bar binding machine 1A including the reel accommodation unit 2.

Furthermore, according to the present embodiment, since the reel accommodation unit 2 is offset in the axis direction of the reel 26 and in the left direction of the twisting motor 80 with respect to the wire feeding unit 3, the feeding path of the wire W is obliquely directed from the wire feeding unit 3 toward the reel 26, so that it is possible to set a locus in a fixed direction when returning the wire W. Thereby, it is possible to limit the buckling places of the wire W and the wear places of the reel accommodation unit 2 and the like, so that it is possible to specify the arrangement places of the buckling prevention part 200 and the wear prevention part 300.

First Modified Embodiment

Figure 9A:
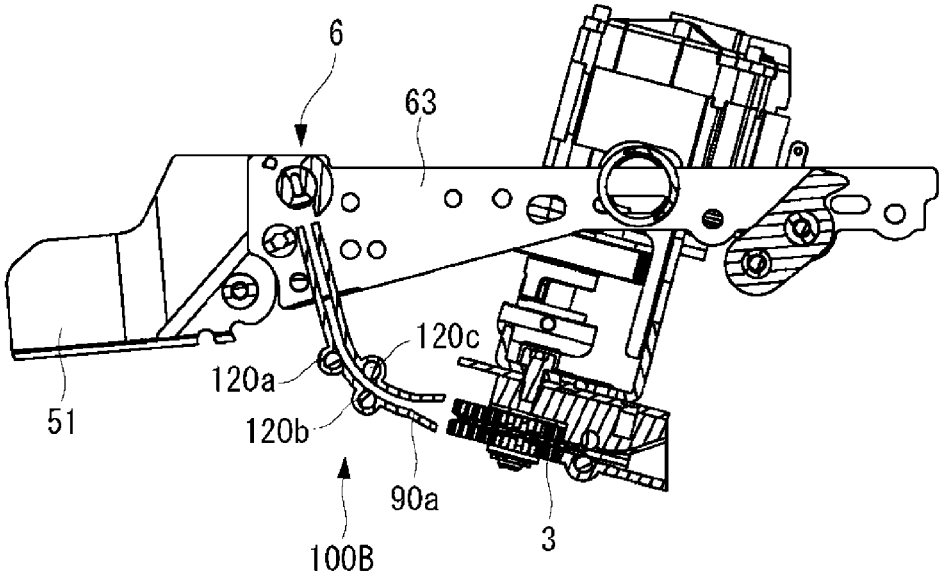
FIG. 9A is a sectional view of a guide part of the reinforcing bar binding machine in accordance with a first modified embodiment.

Subsequently, a guide part 100B of the reinforcing bar binding machine 1A in accordance with a first modified embodiment is described. FIG. 9A depicts the guide part 100B of the first modified embodiment.

As shown in FIG. 9A, the guide part 100B is provided on the first path 90*a* formed between the wire feeding unit 3 and the cutting unit 6, and is configured to guide the wire W when feeding the wire W to the curl forming unit 5 and when pulling back the wire W fed to the curl forming unit 5. The first path 90*a* is configured by a sidewall of a resin material, a metal material or the like, for example, and has a bending portion bent from the wire feeding unit 3 toward the cutting unit 6. Note that, the first path 90*a* may also be configured by a pipe, similarly to the guide part 100A.

The guide part 100B has rigid pins 120*a*, 120*b* and 120*c* provided on the first path 90*a*. The rigid pins 120*a*, 120*b* and 120*c* are each a circular column body, for example, and are each formed of a rigid material such as stainless steel. Both end portions of each of the rigid pins 120*a*, 120*b* and 120*c* in the longitudinal direction are attached to right and left sidewalls (not shown) of the main body 10. Note that, the material of the rigid pin 120*a* and the like is not limited to stainless steel. For example, a known rigid material can be used as appropriate.

The rigid pins 120*a* and 120*b* are arranged with a predetermined interval on a lower surface-side of the first path 90*a*. The rigid pin 120*c* is located on an upper surface-side of the first path 90*a* between the rigid pin 120*a* and the rigid pin 120*b*. A part of a circumferential surface of each of the rigid pins 120*a*, 120*b* and 120*c* is exposed into the first path 90*a*, and can contact the wire W passing through the inside of the first path 90*a*. Even with the guide part 100B, it is possible to achieve the similar effects to the guide part 100A.

Second Modified Embodiment

Figure 9B:
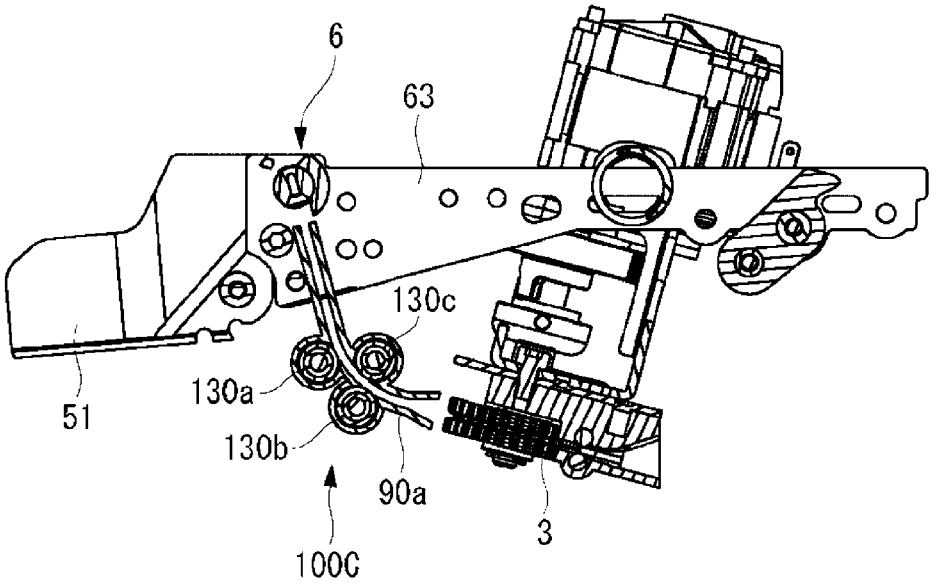
FIG. 9B is a sectional view of a guide part of the reinforcing bar binding machine in accordance with a second modified embodiment.

Subsequently, a guide part 100C of the reinforcing bar binding machine 1A in accordance with a second modified embodiment is described. FIG. 9B depicts the guide part 100C of the second modified embodiment. Note that, the common descriptions to the first modified embodiment are omitted.

As shown in FIG. 9B, the guide part 100C is provided on the first path 90*a* formed between the wire feeding unit 3 and the cutting unit 6, and is configured to guide the wire W when feeding the wire W to the curl forming unit 5 and when pulling back the wire W fed to the curl forming unit 5. The guide part 100C has rollers 130*a*, 130*b* and 130*c* provided on the first path 90*a*. The rollers 130*a*, 130*b* and 130*c* are each a circular column body, for example, and are each formed of a rigid material such as steel and stainless steel. The rollers 130*a*, 130*b* and 130*c* each have a shaft, and both end portions of the shaft in the longitudinal direction are each rotatably supported by the right and left sidewalls of the main body 10.

The rollers 130*a* and 130*b* are arranged with a predetermined interval on a lower side of the first path 90*a*. The roller 130*c* is located on an upper side of the first path 90*a* between the roller 130*a* and the roller 130*b*. A part of a circumferential surface of each of the rollers 130*a*, 130*b* and 130*c* is exposed into the first path 90*a*, and can contact the wire W passing through the inside of the first path 90*a*. Even with the guide part 100C, it is possible to achieve the similar effects to the guide part 100A.

Third Modified Embodiment

Figure 10A:
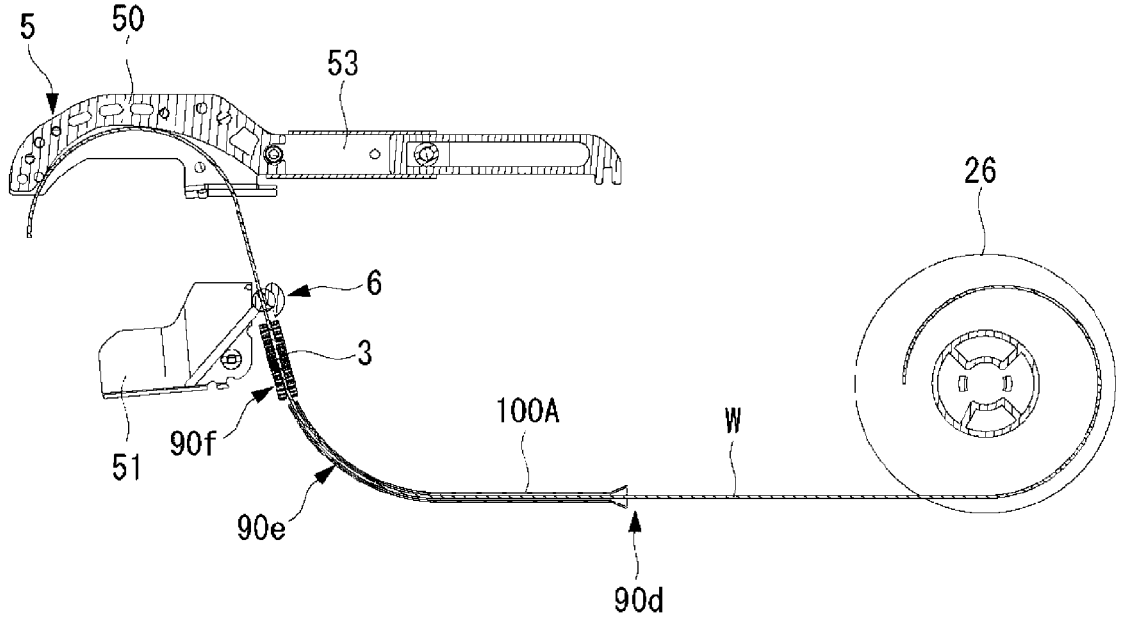
FIG. 10A depicts an arrangement example of the guide part and the wire feeding unit of the reinforcing bar binding machine in accordance with a third modified embodiment.

Subsequently, an arrangement example of the wire feeding unit 3 and the guide part 100A of the reinforcing bar binding machine 1A in accordance with a third modified embodiment is described. FIG. 10A depicts an arrangement example of the wire feeding unit 3 and the guide part 100A of the reinforcing bar binding machine 1A in accordance with the third modified embodiment. In FIG. 10A, a feeding path passing through a lower side in the main body 10 from the reel accommodation unit 2 is referred to as a lower side path 90*d*, a feeding path provided downstream of the lower side path 90*d* and having a bending portion is referred to as a curved path 90*e*, and a feeding path between a downstream side of the curved path 90*e* and the cutting unit 6 is referred to as an intermediate path 90*f*.

As shown in FIG. 10A, the guide part 100A is arranged between a downstream side of the lower side path 90*d* and the curved path 90*e*. The wire feeding unit 3 is arranged on the intermediate path 90*f* on a downstream side of the guide part 100A. Note that, the guide part 100B or the guide part 100C may also be applied, instead of the guide part 100A.

Fourth Modified Embodiment

Figure 10B:
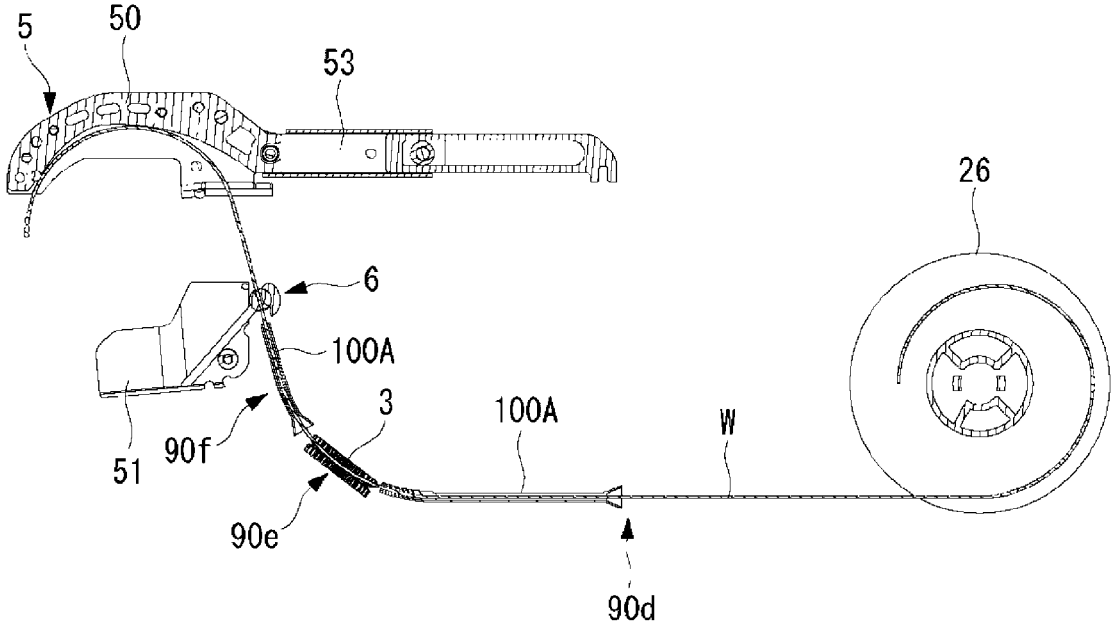
FIG. 10B depicts an arrangement example of the guide part and the wire feeding unit of the reinforcing bar binding machine in accordance with a fourth modified embodiment.

Subsequently, an arrangement example of the wire feeding unit 3 and the guide part 100A of the reinforcing bar binding machine 1A in accordance with a fourth modified embodiment is described. FIG. 10B depicts an arrangement example of the wire feeding unit 3 and the guide part 100A of the reinforcing bar binding machine 1A in accordance with the fourth modified embodiment. Note that, the common descriptions to the third modified embodiment are omitted.

As shown in FIG. 10B, the guide parts 100A are arranged at two places, i.e., on a downstream side of the lower side path 90*d* and on the intermediate path 90*f*. The wire feeding unit 3 is arranged on the curved path 90*e* and between the guide parts 100A and 100A at the two places. Note that, the guide part 100B or the guide part 100C may also be applied, instead of the guide part 100A.

Fifth Modified Embodiment

Figure 10C:
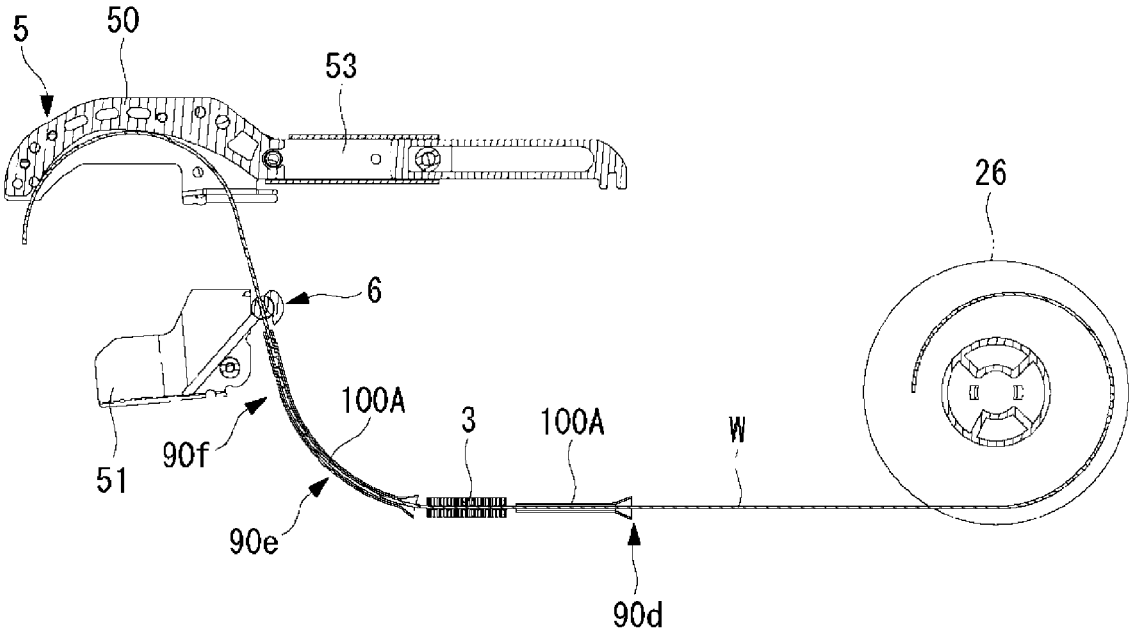
FIG. 10C depicts an arrangement example of the guide part and the wire feeding unit of the reinforcing bar binding machine in accordance with a fifth modified embodiment.

Subsequently, an arrangement example of the wire feeding unit 3 and the guide part 100A of the reinforcing bar binding machine 1A in accordance with a fifth modified embodiment is described. FIG. 10C depicts an arrangement example of the wire feeding unit 3 and the guide part 100A of the reinforcing bar binding machine 1A in accordance with the fifth modified embodiment. Note that, the common descriptions to the third modified embodiment are omitted.

As shown in FIG. 10C, the guide parts 100A are arranged at two places, i.e., between the curved path 90*e* and the intermediate path 90*f* and at a part of the lower side path 90*d*. The wire feeding unit 3 is arranged on a downstream side of the lower side path 90*d* and between the guide parts 100A and 100A at the two places. Note that, the guide part 100B or the guide part 100C may also be applied, instead of the guide part 100A.

Sixth Modified Embodiment

Figure 10D:
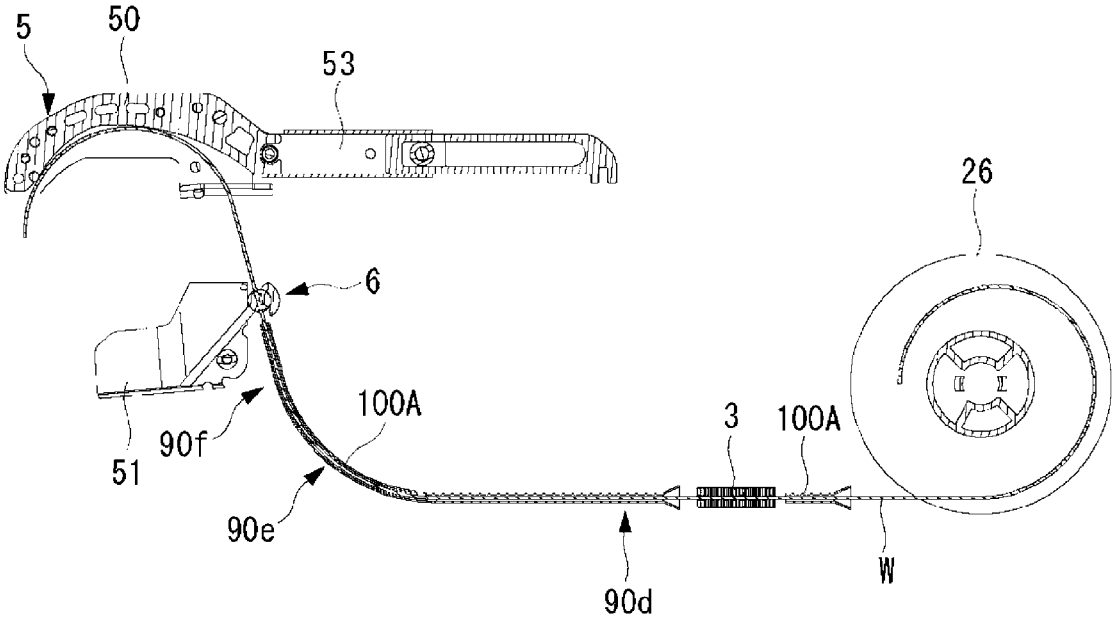
FIG. 10D depicts an arrangement example of the guide part and the wire feeding unit of the reinforcing bar binding machine in accordance with a sixth modified embodiment.

Subsequently, an arrangement example of the wire feeding unit 3 and the guide part 100A of the reinforcing bar binding machine 1A in accordance with a sixth modified embodiment is described. FIG. 10D depicts an arrangement example of the wire feeding unit 3 and the guide part 100A of the reinforcing bar binding machine 1A in accordance with the sixth modified embodiment. Note that, the common descriptions to the third modified embodiment are omitted.

As shown in FIG. 10D, the guide parts 100A are arranged at two places, i.e., on an upstream side of the lower side path 90*d* and from a substantially intermediate position of the lower side path 90*d* to the intermediate path 90*f* via the curved path 90*e*. The wire feeding unit 3 is arranged on the lower side path 90*d* and between the guide parts 100A and 100A arranged at the two places. Note that, the guide part 100B or the guide part 100C may also be applied, instead of the guide part 100A.

Seventh Modified Embodiment

Figure 10E:
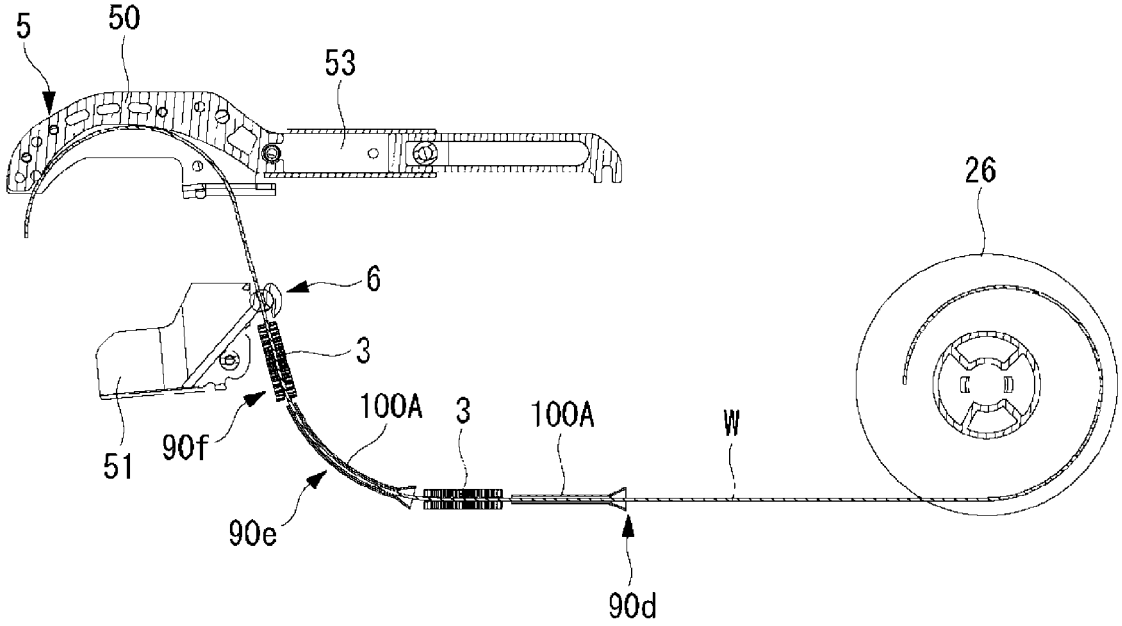
FIG. 10E depicts an arrangement example of the guide part and the wire feeding unit of the reinforcing bar binding machine in accordance with a seventh modified embodiment.

Subsequently, an arrangement example of the wire feeding unit 3 and the guide part 100A of the reinforcing bar binding machine 1A in accordance with a seventh modified embodiment is described. FIG. 10E depicts an arrangement example of the wire feeding unit 3 and the guide part 100A of the reinforcing bar binding machine 1A in accordance with the seventh modified embodiment. Note that, the common descriptions to the third modified embodiment are omitted.

As shown in FIG. 10E, the guide parts 100A are arranged at two places, i.e., on a downstream side of the lower side path 90*d* and on the curved path 90*e*. The wire feeding units 3 are arranged at two places, i.e., between the guide parts 100A and 100A at two places on a downstream side of the lower side path 90*d*, and on the intermediate path 90*f*. Note that, the guide part 100B or the guide part 100C may also be applied, instead of the guide part 100A.

Eighth Modified Embodiment

Figure 11:
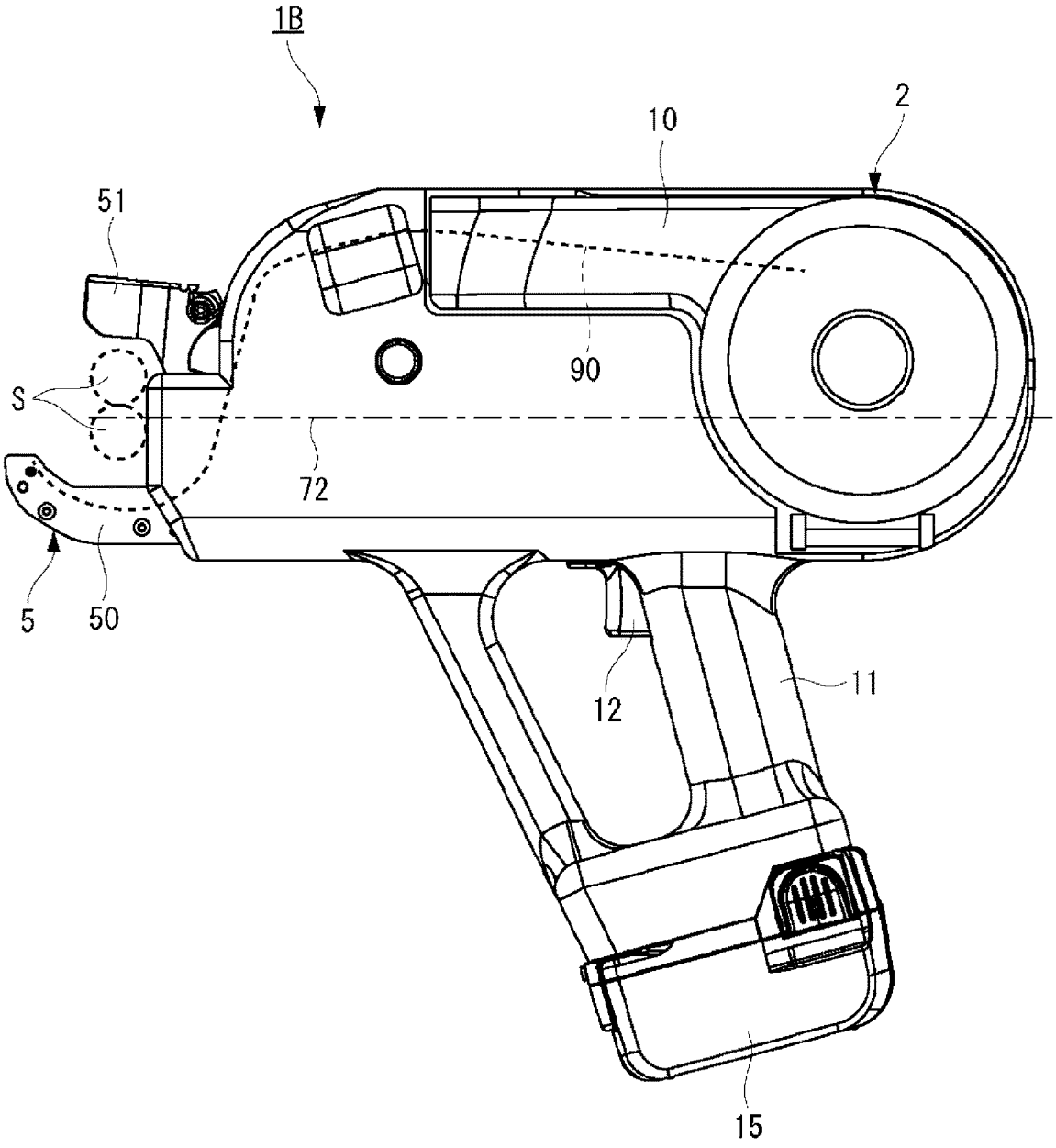
FIG. 11 is a side view of a reinforcing bar binding machine in accordance with an eighth modified embodiment.
Figure 12:
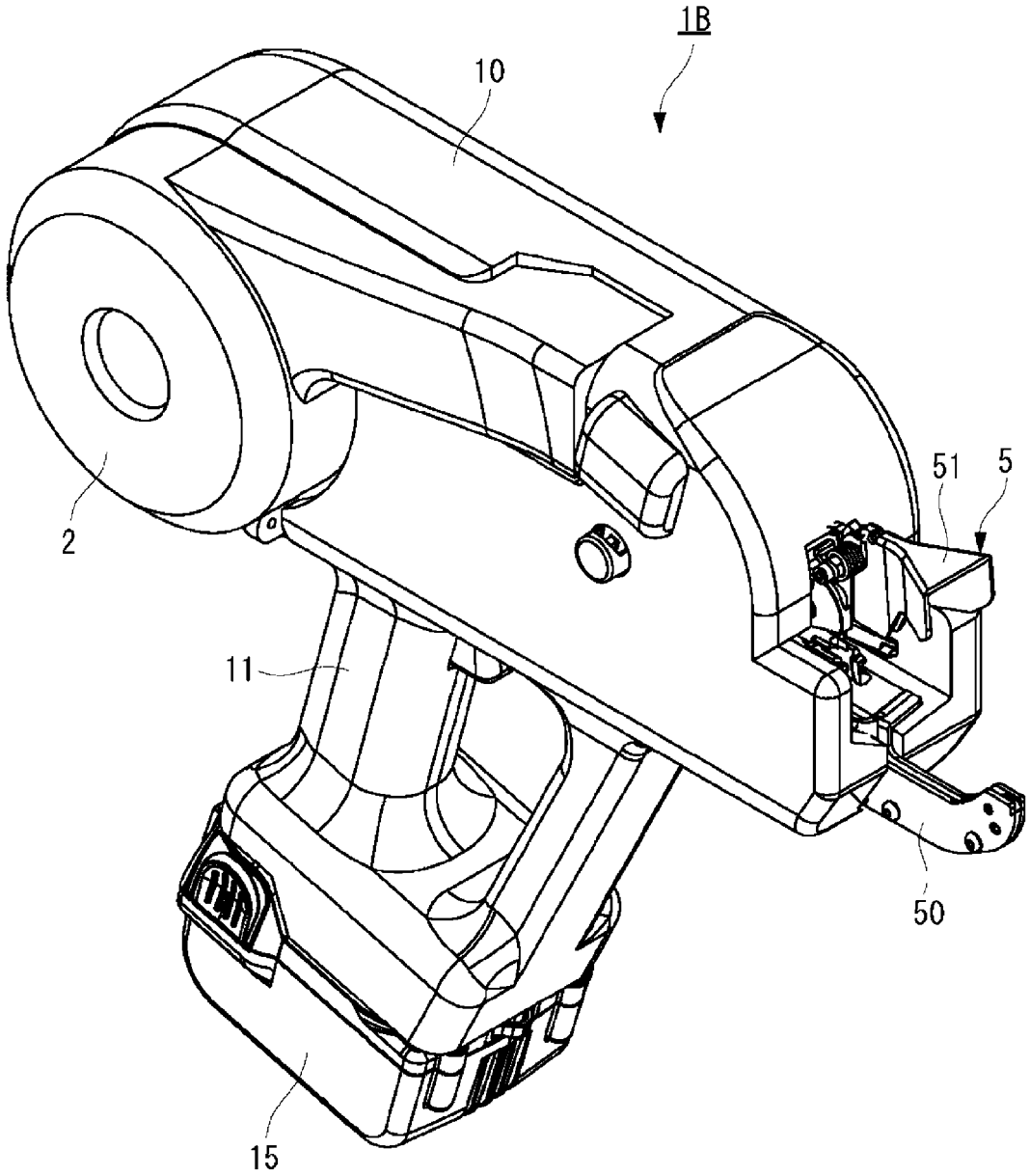
FIG. 12 is a perspective view of the reinforcing bar binding machine in accordance with the eighth modified embodiment.

FIG. 11 is a side view of a reinforcing bar binding machine 1B in accordance with an eighth modified embodiment, and FIG. 12 is a perspective view of the reinforcing bar binding machine 1B in accordance with the eighth modified embodiment. Note that, the constitutional elements having substantially the same functional configurations as the reinforcing bar binding machine 1A are denoted with the same reference signs, and the overlapping descriptions are omitted. In the eighth modified embodiment, the longitudinal direction of the main body 10 is referred to as the front and rear direction, the side on which the curl forming unit 5 is provided is referred to as a front side or tip end-side of the reinforcing bar binding machine 1B, and the side on which the reel accommodation unit 2 is provided is referred to as a rear side of the reinforcing bar binding machine 1B. The side on which the battery 15 is provided and which is a direction orthogonal to the front and rear direction is referred to as a lower side of the reinforcing bar binding machine 1B, and the opposite side thereto is referred to as an upper side of the reinforcing bar binding machine 1B.

The grip 11 extends substantially downward from a lower surface that is a substantially intermediate part of the main body 10 in the longitudinal direction and a part of a circumferential surface of the main body 10. In other words, the grip 11 is provided below the twisting shaft 72 extending in the front and rear direction of the main body 10, and is arranged on an opposite side to the feeding path 90 of the wire W provided in the main body 10 with the twisting shaft 72 being interposed therebetween. The curl guide 50 is arranged below the twisting shaft 72, and is arranged on the same side as the grip 11 with respect to the twisting shaft 72. The feeding path 90 is arranged above the twisting shaft 72 and on an upper side in the main body 10.

Similarly to the reinforcing bar binding machine 1A, the feeding path 90 may be provided with the guide part 100A, 100B, 100C, the buckling prevention part 200 and the wear prevention part 300. Even with the reinforcing bar binding machine 1B of the eighth modified embodiment, it is possible to achieve the similar operational effects to the reinforcing bar binding machine 1A.

Although the favorable embodiments of the present disclosure have been described in detail with reference to the accompanying drawings, the technical scope of the present disclosure is not limited thereto. A variety of changes or modifications that can be conceived within the scope of the technical spirit defined in the claims by one skilled in the art of the present disclosure are included in the technical scope of the present disclosure.

For example, in the above embodiments, the reinforcing bar binding machine 1A and the like where the to-be-bound object is surrounded by the curled wire W and the wire W is then pulled back have been described. However, the present disclosure is not limited thereto. For example, the technology of the present embodiment where the reel accommodation unit is arranged at the rear part of the main body can also be applied to a reinforcing bar binding machine where the wire W is not pulled back after the curled wire W is wound around the to-be-bound object.

What is claimed is:

1. A binding machine configured to feed a wire in a first direction, to curl the wire, to surround a to-be-bound object with the wire, to return the wire in a second direction opposite to the first direction, to wind the wire on the to-be-bound object, and to twist the wire, thereby binding the to-be-bound object, the binding machine comprising:

a main body;

a reel accommodation unit configured to rotatably accommodate a reel on which the wire is wound;

a wire feeding unit provided in the main body and configured to feed the wire in the first direction and in the second direction;

a curl guide provided on a tip end-side of the main body and configured to curl the wire fed by the wire feeding unit;

a binding unit comprising a twisting shaft extending from the tip end-side to a rear end-side of the main body, and configured to twist the wire curled by the curl guide by rotation of the twisting shaft;

a grip extending from a circumferential surface of the main body;

a starter provided to the grip and configured to start the wire feeding unit; and a feeding path provided in the main body for feeding the wire in the first direction or in the second direction, wherein the reel accommodation unit is provided in the main body on an opposite side to the curl guide with respect to the starter, wherein the feeding path is provided with a load reducing part configured to reduce a load of the wire or the reel accommodation unit, wherein the feeding path is provided between the reel accommodation unit and the wire feeding unit, and the load reducing part is at least partially positioned along the feeding path at a location between the reel accommodation unit and the wire feeding unit, and wherein the load reducing part comprises a buckling prevention part positioned between the reel accommodation unit and the wire feeding unit along the feeding path and configured to support the wire when feeding the wire in the second direction.

2. The binding machine according to claim 1, wherein the feeding path is provided between the wire feeding unit and the curl guide, and comprises a bending portion configured to bend the wire from the wire feeding unit toward the curl guide, and wherein the load reducing part comprises a guide part configured to reduce friction of the wire against the bending portion when feeding the wire in the first direction or in the second direction.

3. The binding machine according to claim 2, wherein the guide part includes a pipe having a diameter larger than a diameter of the wire.

4. The binding machine according to claim 1, wherein the buckling prevention part includes two surfaces which have different inclinations, and wherein a connection part where the two surfaces are connected to each other is configured to contact the wire.

5. The binding machine according to claim 1, wherein the feeding path and the grip are provided on one side with respect to the twisting shaft, and wherein the curl guide is provided on the other side with respect to the twisting shaft.

6. The binding machine according to claim 1, wherein the feeding path is provided on one side with respect to the twisting shaft, and wherein the curl guide and the grip are provided on the other side with respect to the twisting shaft.

7. The binding machine according to claim 1, wherein the wire feeding unit includes a feeding motor which is driven in a forward direction to feed the wire in the first direction, and the feeding motor is driven in a reverse direction to feed the wire in the second direction.

8. The binding machine according to claim 1, wherein the wire feeding unit comprises a pair of feeding gears, and the buckling prevention part is between the pair of feeding gears and the reel accommodation unit.

9. A binding machine configured to feed a wire in a first direction, to curl the wire, to surround a to-be-bound object with the wire, to return the wire in a second direction opposite to the first direction, to wind the wire on the to-be-bound object, and to twist the wire, thereby binding the to-be-bound object, the binding machine comprising:

a main body;

a reel accommodation unit configured to rotatably accommodate a reel on which the wire is wound;

a wire feeding unit provided in the main body and configured to feed the wire in the first direction and in the second direction;

a curl guide provided on a tip end-side of the main body and configured to curl the wire fed by the wire feeding unit;

a binding unit comprising a twisting shaft extending from the tip end-side to a rear end-side of the main body, and configured to twist the wire curled by the curl guide by rotation of the twisting shaft;

a grip extending from a circumferential surface of the main body;

a starter provided to the grip and configured to start the wire feeding unit; and a feeding path provided in the main body for feeding the wire in the first direction or in the second direction, wherein the reel accommodation unit is provided in the main body on an opposite side to the curl guide with respect to the starter, wherein the feeding path is provided with a load reducing part configured to reduce a load of the wire or the reel accommodation unit, wherein the feeding path includes a first path in the reel accommodation unit, the feeding path further including a second path between the reel accommodation unit and the wire feeding unit, and wherein the load reducing part comprises at least one wear reducing part configured to reduce wear due to feeding the wire in the second direction, the at least one wear reducing part positioned along the first path in the reel accommodation unit, the at least one wear reducing part further positioned along the second path between the reel accommodation unit and the wire feeding unit.

10. The binding machine according to claim 9, wherein the wire feeding unit includes a feeding motor which is driven in a forward direction to feed the wire in the first direction, and the feeding motor is driven in a reverse direction to feed the wire in the second direction.

11. The binding machine according to claim 9, wherein the at least one wear reducing part includes a first plate in the reel accommodation unit and a second plate disposed along the second path between the reel accommodation unit and the wire feeding unit.

12. The binding machine according to claim 9, wherein the at least one wear reducing part comprises:

a first plate in the reel accommodation unit;

a second plate provided on a sidewall along the second path; and a third plate provided on a bottom wall along the second path, wherein at least part of the second plate and at least part of the third plate are between the reel accommodation unit and the wire feeding unit.

13. The binding machine according to claim 12, wherein the third plate extends between the bottom wall along the second path and an inside of the reel accommodation unit.

14. A binding machine configured to feed a wire in a first direction, to curl the wire, to surround a to-be-bound object with the wire, to return the wire in a second direction opposite to the first direction, to wind the wire on the to-be-bound object, and to twist the wire, thereby binding the to-be-bound object, the binding machine comprising:

a main body;

a reel accommodation unit configured to rotatably accommodate a reel on which the wire is wound;

a wire feeding unit provided in the main body and configured to feed the wire in the first direction and in the second direction;

a curl guide provided on a tip end-side of the main body and configured to curl the wire fed by the wire feeding unit;

a binding unit comprising a twisting shaft extending from the tip end-side to a rear end-side of the main body, and configured to twist the wire curled by the curl guide by rotation of the twisting shaft;

a grip extending from a circumferential surface of the main body;

a starter provided to the grip and configured to start the wire feeding unit; and a feeding path provided in the main body for feeding the wire in the first direction or in the second direction, wherein the reel accommodation unit is provided in the main body on an opposite side to the curl guide with respect to the starter, wherein with the binding machine oriented such that the grip extends downwardly and the twisting shaft is horizontal, the grip is provided on one side with respect to the twisting shaft, the one side being on a lower side with respect to the twisting shaft, wherein the curl guide is provided on the one side with respect to the twisting shaft, wherein at least part of the feeding path is on a side opposite to the one side with respect to the twisting shaft, the side opposite to the one side with respect to the twisting shaft being an upper side, and wherein a portion of the feeding path which receives wire from the reel of the reel accommodation unit is in the upper side with respect to the twisting shaft.

15. The binding machine according to claim 14, wherein:

with the binding machine oriented such that the twisting shaft is horizontal, the grip and at least a portion of the feeding path are below the twisting shaft, and the curl guide is also below the twisting shaft.

16. The binding machine according to claim 15, further including a buckling prevention part configured to support a portion of the wire fed in the second direction and prevent buckling of the wire fed in the second direction.

17. The binding machine according to claim 14, further including a buckling prevention part configured to support a portion of the wire fed in the second direction and prevent buckling of the wire fed in the second direction.

* * * * *